US006445144B1

(12) United States Patent
Wuidart et al.

(10) Patent No.: US 6,445,144 B1
(45) Date of Patent: Sep. 3, 2002

(54) CURRENT SURGE LIMITING CIRCUIT

(75) Inventors: Luc Wuidart, Pourrieres; Michel Bardouillet, Rousset, both of (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/124,401

(22) Filed: Jul. 29, 1998

(30) Foreign Application Priority Data

Jul. 31, 1997 (FR) ..... 97 10034

(51) Int. Cl.[7] ..... H05B 37/00
(52) U.S. Cl. ..... 315/310; 315/71; 315/125
(58) Field of Search ..... 315/360, 362, 315/119, 125, 225, 208, 200 R, 310, 71

(56) References Cited

U.S. PATENT DOCUMENTS 4,570,108 A * 2/1986 Stroede et al. ..... 315/360
4,701,675 A * 10/1987 Masaki ..... 315/310
4,772,804 A 9/1988 Grimaud et al. ..... 307/10 LS
5,239,255 A 8/1993 Schanin et al. ..... 323/237

FOREIGN PATENT DOCUMENTS

EP A-0 735 798 10/1996 ..... H05B/39/04

OTHER PUBLICATIONS

French Search Report from French Patent Application 97 10034, filed Jul. 31, 1997.

* cited by examiner

*Primary Examiner*—David Vu
(74) *Attorney, Agent, or Firm*—Wolf, Greenfield & Sacks, P.C.; James H. Morris

(57) ABSTRACT

The present invention relates to a surge current limiting circuit of a filament lamp, meant to be connected in series between the filament and a switch that supplies an a.c. voltage, including at least one controllable active element, for limiting the current to a predetermined threshold value.

25 Claims, 4 Drawing Sheets

CURRENT SURGE LIMITING CIRCUIT

BACKGROUND OF THE INVENTION

1. Field of the Invention

The present invention relates to the field of filament lamps and, more specifically, to incandescent or halogen lamps, especially of high voltage.

2. Discussion of the Related Art

FIG. 1 shows the conventional electric connection diagram of a lamp L, for example an incandescent lamp, to the electric network supplying an a.c. voltage Vac, for example of 230 volts RMS. Lamp L is connected in series with a turn on switch K between two terminals P, N that voltage Vac is applied to. Generally, switch K is interposed between phase terminal P of the single-phase a.c. voltage and lamp L. A protection device, generally a fuse or a circuit-breaker, of the electric panel of the installation is interposed between the line of the electric network and the circuit shown in FIG. 1.

Upon each lighting of the lamp by the closing of switch K, there appears a current surge, the instantaneous value of which is several times higher than that of the nominal operating current. The amplitude of the surge current peak varies according to the temperature of the filament of lamp L and to the instantaneous value of voltage Vac at the time the switch is closed. At low temperature and at the peak of a halfwave of voltage Vac, this surge current can reach up to fifteen times the current in the nominal state. The stress then undergone by the lamp filament reduce its lifetime. Filament lamps generally have a maximum lifetime on the order of 1000 hours.

FIG. 2 illustrates, in the form of timing diagrams, the shape of voltage $V_L$ across lamp L and of current $I_L$ in the filament of lamp L. In FIG. 2, a closing of switch K has been assumed to occur at a time $t_1$. A peak of current $I_L$ appears at time $t_1$ and this peak takes several halfwaves to damp so that the current in the lamp oscillates between nominal peak values Inom and -Inom.

This phenomenon is mainly linked to the variation of the value of the resistance of the filament of lamp L according to temperature. At low temperature, the filament resistance is lowest. The nominal power of the lamp is determined by the value of the filament resistance at high temperature, once the lamp has been lit. As a specific example, for a voltage Vac of 230 volts RMS., a 60 watt bulb has a filament resistance value on the order of 880 ohms at high temperature. At low temperature, if the value of the resistance is divided by 10, which corresponds to a usual proportion and if the lighting is performed at the peak of voltage Vac, that is, 340 instantaneous volts, the same lamp and the network line see an instantaneous power peak of more than 1200 watts.

In addition to the fact that these power peaks break most incandescent lamps, that is, they break the filament upon power-on, an arc may appear between a free end of the filament and the bulb cap, and this arc is likely to cause the fusing of the protection fuse involved, and thus installation servicing costs.

The same phenomenon can be observed in halogen lamps provided with a filament, in particular, for high-voltage halogen lamps, that is, lamps which are not supplied via a step-down transformer.

Another disadvantage of current peaks upon lighting of a filament lamp is that the disturbances on the lamp supply line are likely to damage other devices connected on the same circuit, that is, downstream of the same fuse.

A conventional solution to overcome these disadvantages is to provide, in series with the lamp, a negative coefficient thermistance, that is, a resistance, the value of which decreases with temperature. Such a solution has several disadvantages. First, the thermistance is prejudicial to the lighting installation since its resistance at high temperature remains non-negligible and thus results in power dissipation. Thermistances having very high low temperature values must indeed be chosen to sufficiently limit the current peak. As a result, the power effectively provided by the lamp does not correspond to its nominal value. Second, a thermistance cools down more slowly than the filament of an incandescent lamp. Accordingly, thermistance protection is inefficient in case of repeated lightings of the lamp, at short time intervals.

In other applications, it has already been provided to limit surge current peaks at the turning on of a device, by means of an electronic control circuit controlling the power-on so that it occurs at a zero crossing of the a.c. voltage. Such a solution is however not adapted to filament lamps. Indeed, although such a solution would reduce the current peak amplitude upon closing of switch K (time $t_1$), the current in the lamp would however exceed the nominal values during several halfwaves and would then no longer be limited, during the time required by the filament to heat up sufficiently for its resistance to reach its nominal value. Further, the implementation of such a solution requires a complex electronic circuit requiring, most often, the generation of a low biasing voltage of the electronic components forming it.

SUMMARY OF THE INVENTION

The present invention aims at providing a novel solution to limit the surge current in a filament lamp.

The present invention aims, in particular, at providing a device which maintains the current in the lamp between the nominal values for which the lamp has been developed.

The present invention also aims at providing a device which is of simple constitution and of low cost.

The present invention also aims at providing power to the device without using specific power supply means.

The present invention further aims at providing a device of low bulk.

To achieve these and other objects, the present invention provides a circuit for limiting the surge current of a filament lamp, adapted to be connected in series between the filament and a switch that can supply an a.c. voltage, and including at least one controllable active element, for limiting the current to a predetermined threshold value.

According to an embodiment of the present invention, the threshold value is set by means of a resistor that is used to measure the current through the lamp.

According to an embodiment of the present invention, the circuit includes at least one limiting element in series with the measurement resistor, a control terminal of the limiting element being connected to a control means, detecting the voltage across the measurement resistor.

According to an embodiment of the present invention, the means is formed of a bipolar transistor, between the base and the emitter of which is connected the measurement resistor, the limiting element being controlled in linear mode.

According to an embodiment of the present invention, the means is formed of a comparator that compares the voltage across the measurement resistor with respect to a predetermined reference value, the limiting element being controlled in switched mode.

According to an embodiment of the present invention, the limiting element is biased, outside limiting periods, by a resistor connected between one of the power terminals of this element and its control terminal.

According to an embodiment of the present invention, the active element is connected as a unidirectional limiter and is associated with a rectifying bridge.

According to an embodiment of the present invention, the circuit includes two limiting elements, to limit the current in the lamp to the predetermined threshold value, each element being mounted as a unidirectional limiter.

According to an embodiment of the present invention, the circuit includes two field effect MOS transistors, connected in series between the switch and the filament, the measurement resistor being interposed between the two transistors and the current path including, upon each halfwave of the supply voltage, a parasitic diode of one of the two field effect transistors.

The present invention also relates to a filament bulb including, in its cap, a current limiting circuit.

The foregoing objects, features and advantages of the present invention will be discussed in detail in the following non-limiting description of specific embodiments in connection with the accompanying drawings.

DETAILED DESCRIPTION

Figure 1:
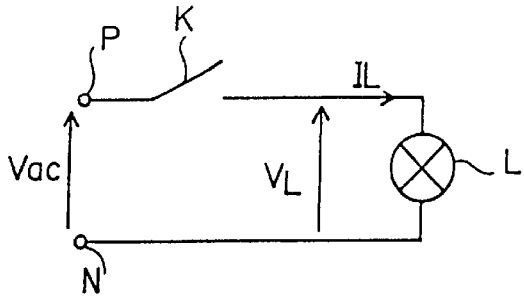
FIG. 1 (PRIOR ART)
FIGS. 1 and 2, previously described, are meant to show the state of the art and the problem to solve.
Figure 2:
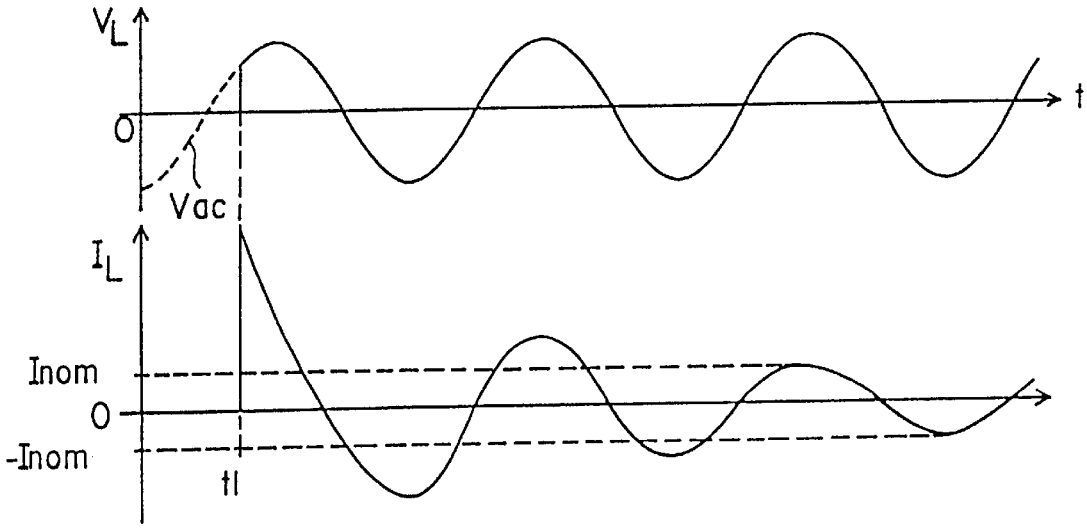
FIG. 2 (PRIOR ART)
Figure 7:
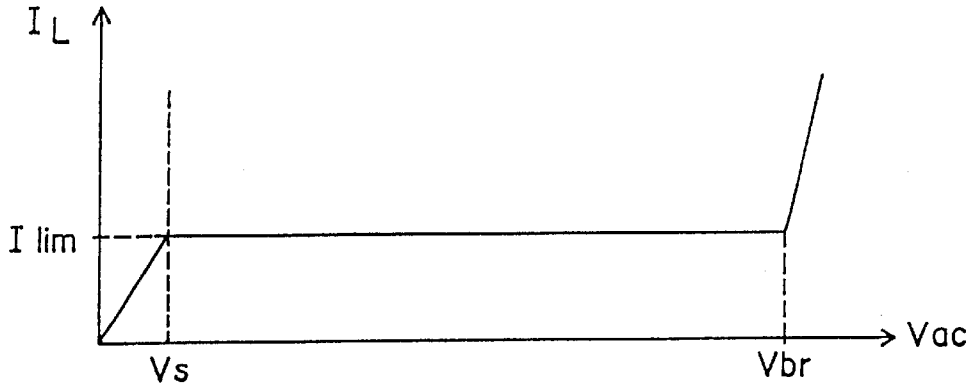
FIG. 7 shows the current-voltage characteristic of a current limiting circuit according to the present invention.

The same elements have been designated with the same references in the different drawings. For clarity, the timing diagrams of FIGS. 2 and 4 and the characteristic of FIG. 7 are not to scale.

Figure 3:
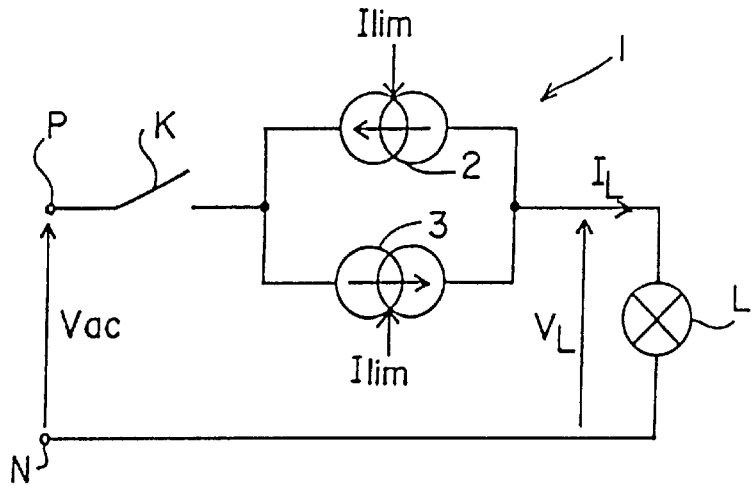
FIG. 3 shows a simplified diagram of a current limiting circuit associated with a filament lamp according to the present invention.

FIG. 3 schematically shows a circuit for lighting a filament lamp L from an a.c. voltage Vac, for example, the mains voltage, according to an embodiment of the present invention. Conventionally, lamp L is connected in series with a switch K between two a.c. supply terminals P, N.

A feature of the present invention is to connect, in series with lamp L and, preferably, between switch K and lamp L, a bidirectional current limiting circuit 1, the function of which is to clamp current $I_L$ taken from the supply to a predetermined threshold voltage.

According to the present invention, device 1, symbolized in FIG. 3 by two controllable one-way limiting elements 2, 3, is formed, at least partly, of active components. Each element 2, 3, is meant to clamp the current by limiting it to a threshold value Ilim and elements 2 and 3 operate in turns according to the halfwave of voltage Vac.

Figure 4:
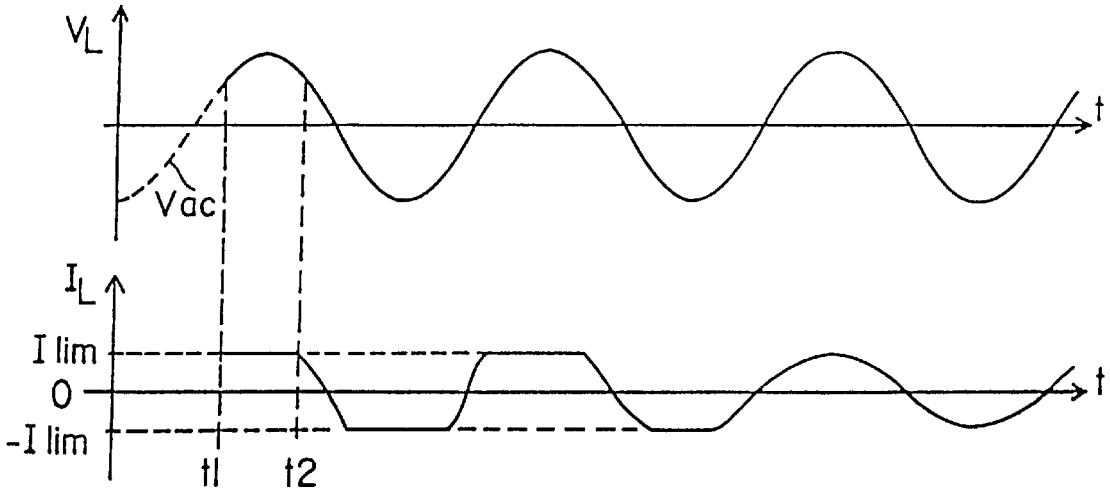
FIG. 4 illustrates, in the form of timing diagrams, the operation of a current limiting circuit according to the present invention.

FIG. 4 illustrates, in the form of timing diagrams representing voltage $V_L$ across lamp L and current $I_L$ flowing through this lamp, the operation of the circuit shown in FIG. 3. It is assumed that switch K is closed at a time $t_1$ in a positive halfwave of voltage Vac. Since the resistance of the filament of lamp L is very low, current $I_L$ increases abruptly and is limited to threshold value Ilim by element 3. During this first halfwave which follows the closing of switch K, current $I_L$ remains at value Ilim as long as the voltage across lamp L has not become low enough for the filament resistance to be sufficient for current $I_L$ to be lower than value Ilim (time $t_2$). The same operation is repeated at the next (negative) halfwave by the action of element 2 since the lamp filament does not have the time to heat up sufficiently during a halfwave for its resistance to reach its nominal value. This operation is thus repeated in the following halfwaves as long as this lamp filament resistance is not sufficient to maintain current $I_L$ between Ilim and -Ilim. In the example shown in FIG. 4, the case of a value Ilim corresponding to the value of the nominal current in the lamp once the filament is hot has been considered. It should however be noted that current Ilim is, preferably, set to a value slightly higher than the nominal lamp current, in particular, to take into account the tolerances of voltage Vac (generally, ±15%) so that elements 2 and 3 are not in permanent limiting operation.

An advantage of the present invention is that it avoids any power peak in lamp L upon its turning-on. The lifetime of the filament lamp is thereby increased.

Another advantage of the present invention is that device 1 protects the filament of lamp L, even in nominal operation, for example, in case of an accidental overvoltage of the a.c. supply.

Another advantage of the present invention is that it reduces any risk of damaging another electric device supplied from the same fuse, in particular in the case where the fuse is oversized.

Another advantage of the present invention is that it avoids, in case of a filament breaking, the propagation of a current peak linked to the occurrence of an arc between a free end of the filament and the bulb cap.

Figure 5:
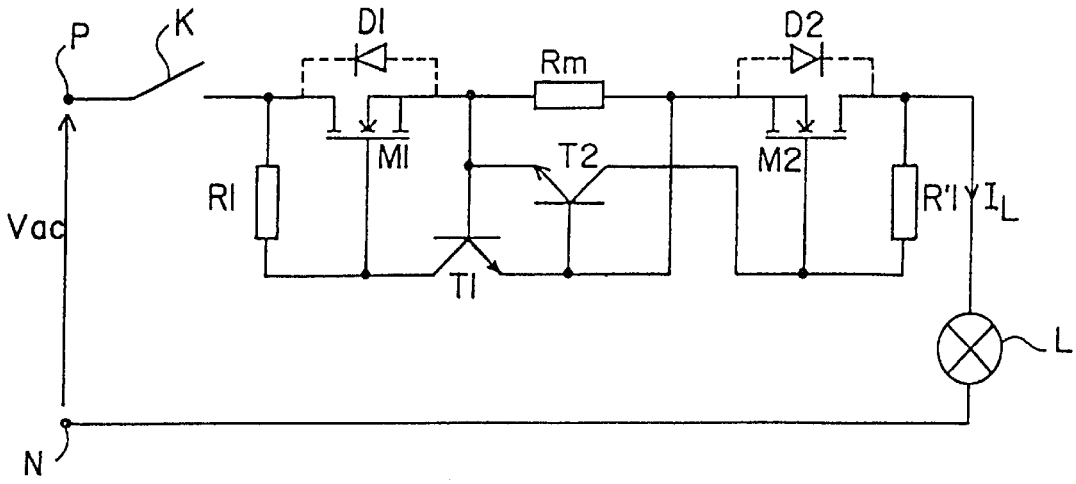
FIG. 5 shows a first embodiment of a current limiting circuit according to the present invention.

FIG. 5 shows a first embodiment of a limiting circuit according to the present invention.

The device includes, between switch K and lamp L, two field-effect, preferably N-channel, MOS transistors M1 and M2, connected as adjustable current sources, and between the sources of which is interposed a resistor Rm used to measure the current. The drain of transistor M1 is connected to the terminal of switch K, on the lamp side, and the drain of transistor M2 is connected to a first terminal of the lamp, the second terminal of which is connected, for example, to neutral point N of the a.c. supply. The source of each transistor M1, M2, is also connected to the base of a bipolar transistor T1, T2, the collector of which is connected to the gate of the corresponding transistor M1, M2 and, via a biasing resistor R1, R'1, to the drain of this transistor M1, M2. The emitter of transistor T1 is connected to the source of transistor M2, and the emitter of transistor T2 is connected to the source of transistor M1. Transistors T1 and T2 detect the voltage across resistor Rm and control, respectively, transistors M1 and M2.

A feature of the invention is that each limiting element (here transistors M1 and M2) is associated with a resistive biasing element (here resistors R1 and R'1) connected between one of its power terminals and its control terminal. This resistive element serves as a local supply element and avoids the generation of a bias voltage by a complex circuit.

Limiting value Ilim depends on the value of resistor Rm. As long as the voltage drop across resistor Rm is lower than the base-emitter junction voltage of bipolar transistor T1 or T2, this transistor remains off and MOSFET transistor M1 or M2 associated therewith is maintained on, by being biased by resistor R1, R'1, in its operating range where its gate-source voltage (VgsON) is approximately equal to its drain-source voltage (VdsON), and thus exhibits a low voltage drop. When current $I_L$ becomes such that the voltage drop across resistor Rm is higher than the junction voltage of one of transistors T1, T2, the corresponding transistor M1, M2 then operates in linear mode, that is, in its current limiting range.

In the assembly of FIG. 5, transistors M1, T1, and resistor R1 operate during positive halfwaves, and transistors M2, T2 as well as resistor R2, operate during negative halfwaves. Resistor Rm is used as a current measurement resistor whatever the considered halfwave.

In positive halfwaves, parasitic diode D2 of transistor M2 is forward biased and resistor Rm is thus connected to lamp L neglecting the voltage drop (approximately 0.7 volts) in parasitic diode D2. In negative halfwaves, a similar function is performed by parasitic diode D1 of transistor M1 and resistor Rm is thus connected to switch K, neglecting the voltage drop in this parasitic diode.

It should be noted that other unidirectional current limiting components can be used instead of transistors M1 and M2. For example, two IGBT transistors may be used. In this case, diodes D1, D2 are added in parallel with the IGBT transistors to enable the bidirectional operation of the limiting circuit.

Figure 6:
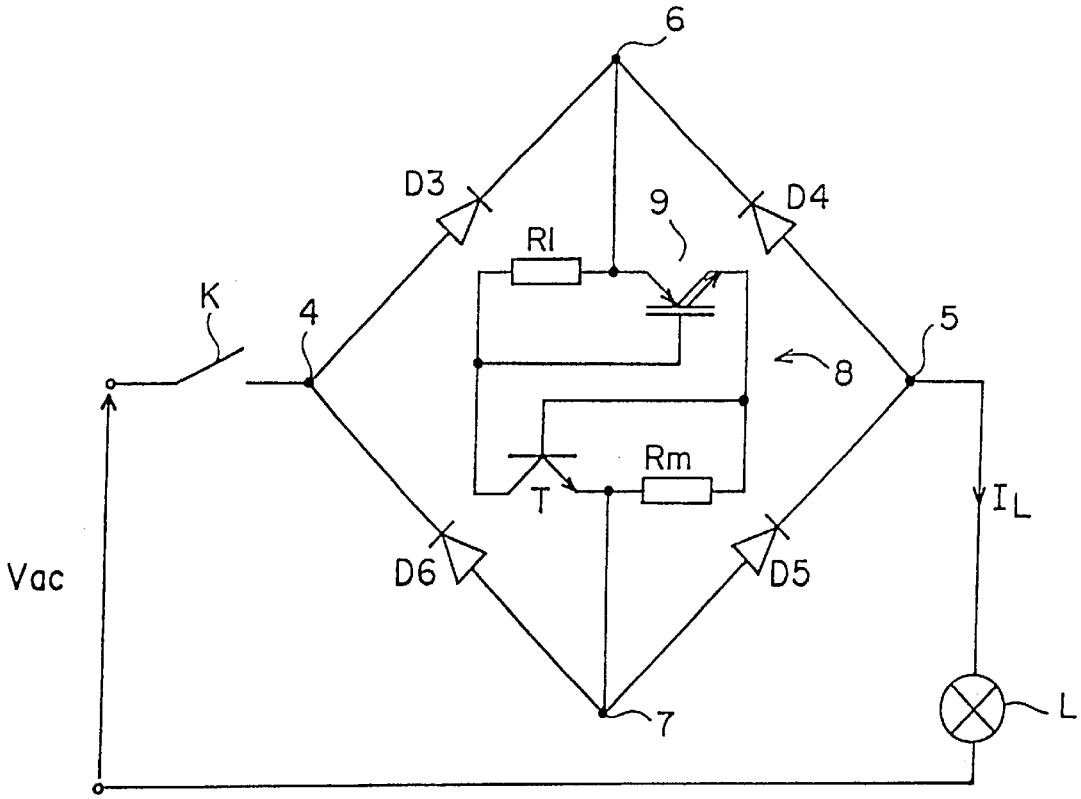
FIG. 6 shows a second embodiment of a current limiting circuit according to the present invention.

FIG. 6 shows a second embodiment of the present invention in which a diode bridge D3, D4, D5, and D6 is used to render bidirectional a unidirectional limiting circuit, for example, one of the circuits of FIG. 5.

Two a.c. input terminals 4, 5, of the diode bridge are respectively connected to an output terminal of switch K and to an arbitrarily called input terminal of lamp L. A unidirectional limiting circuit 8 is connected between two output terminals 6, 7 of the diode bridge, that is, between the anodes of diodes D3 and D4 and the cathodes of diode D5 and D6.

Limiting circuit 8 includes, as previously, a measurement resistor Rm in series with a limiting element, here, an IGBT transistor 9, between switch K and lamp L, here between terminals 6 and 7. The gate of the IGBT transistor is connected to the collector of a bipolar control transistor T, the emitter of which is connected to terminal 7 and the base of which is connected to the emitter of the IGBT transistor, that is, resistor Rm is placed in parallel between the base and the emitter of transistor T. A biasing resistor R1 is connected between terminal 6 and the collector of transistor T.

The operation of the assembly of FIG. 6 can be induced from the operation discussed in relation with FIG. 5. In positive halfwaves, the current flows through diode D3, through transistor 9, through resistor Rm, and through diode D5. In negative halfwaves, the current flows through diode D4, through transistor 9, through resistor Rm, and through diode D6.

Other components or assemblies than those discussed in relation with FIGS. 5 and 6 may be used to form the unidirectional current limiting circuit of the present invention. For example, a cascode-type MOSFET and bipolar combination technology, or Darlington-mounted bipolar transistors, may be used.

The current-voltage characteristic that a unidirectional limiting element (M1, M2, FIGS. 5–9, FIG. 6) according to the present invention must respect is shown in FIG. 7. As long as current $I_L$ remains lower than limiting value Ilim, the limiting element behaves as a resistor of very low value (corresponding to the value of the series resistance of an on MOSFET transistor or of an IGBT transistor). As soon as current $I_L$ reaches the limiting value set by resistor Rm, the element limits current $I_L$ to this value, whatever voltage Vac, provided that this voltage remains lower than a limiting avalanche value Vbr of the limiting element (MOSFET transistor M1, M2, or an IGBT transistor).

Value Vs of the threshold voltage between the two operating modes of the device corresponds, in the embodiment of FIG. 6, to the voltage drop in two diodes of the bridge, plus the voltage drop in resistor Rm and the series voltage drop in limiting element 9.

An advantage of the present invention is that the limiting circuit includes few components only and is easily integrable, preferably, in the cap of an incandescent lamp or in a lamp socket. The integration of a limiting circuit in the bulb cap has the advantage of linking the limiting current to the lamp power. Thus, permanent power dissipation by the limiting device, linked to its permanent operation in limiting mode is avoided, if the bulb has a power higher than that for which the device is sized.

Such an integration is facilitated by the fact that the limiting element is biased, outside the limiting periods, by a simple resistive element avoiding the need of a third access terminal of the circuit. Thus, a feature of the invention is that the limiting circuit is a "two lead" circuit and can thus be connected in series with the filament of the lamp without needing a connection of the two ac supply terminals.

As a specific example of implementation, for an incandescent lamp of 60 watts, having a nominal filament resistance (that is, a resistance at high temperature) on the order of 880 ohms for a voltage of 230 volts RMS., the nominal operating current (that is, the maximum intensity in nominal operation) is on the order of 370 mA. A limiting circuit according to the present invention, sized with a resistance Rm of 1.2 ohms, clamps the current from approximately 500 mA and thus enables proper operation and a minimum power dissipation even in case of a variation of the supply voltage in the tolerance range (±15%) of supply of the a.c. mains voltage.

Figure 8:
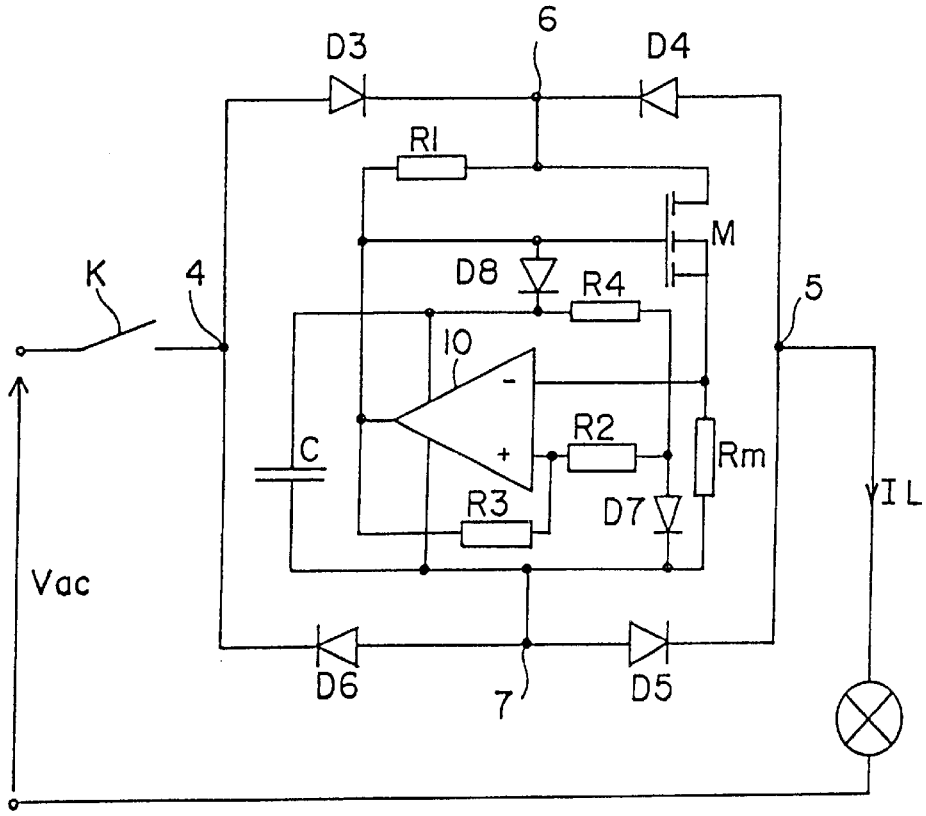
FIG. 8 shows a third embodiment of a current limiting circuit according to the present invention.

FIG. 8 shows a third embodiment of a current limiting circuit according to the present invention. This circuit still is formed of at least one active element, for example, a MOSFET transistor M or an IGBT transistor, controllable to limit the current to a predetermined threshold value. Transistor M is connected in series with a current measurement resistor and the limiting circuit includes a means of detection of the voltage across this measurement resistor to control transistor M.

A characteristic of this embodiment is that transistor M is controlled in switched mode, that is, it is turned off as soon as the current in resistor Rm reaches the determined threshold value and it is turned back on after a short time interval. This amounts, considering the shape of current $I_L$ in FIG. 4, to chopping this current between times t1 and t2. An advantage is that the power dissipation is thus reduced during limiting periods. This advantage is particularly substantial in the case of a limiting circuit connected upstream of the bulb, for example in the lamp socket, since the power dissipation is reduced if the bulb exhibits a higher power than that for which the device is sized. As with the other embodiments, transistor M is associated with a biasing resistor R1 enabling to turn it on. In the example shown in FIG. 8, the limiting circuit is a unidirectional circuit and is associated with a diode bridge D3, D4, D5, D6 to make it bidirectional, transistor M in series with resistor Rm being connected between terminals 6 and 7 of the bridge. The detection means here is formed of a comparator 10, for example, a differential amplifier, an inverting input of which is connected to the midpoint of the series association of transistor M and of resistor Rm. The non-inverting input of comparator 10 receives a reference. voltage determined, for example, by a diode D7, the cathode of which is connected to terminal 7 and the anode of which is connected, via a resistor R2, to the non-inverting input. The output of comparator 10 is connected to the gate of transistor M and, via a resistor R3, to its non-inverting input. The dividing bridge formed of resistors R2 and R3 conditions a hysteresis around the reference voltage determined by diode D7, so that the assembly oscillates. Comparator 10 is supplied by means of a capacitor C associated with a diode D8, resistor R1, diode D8 and capacitor C being connected in series between terminals 6 and 7. A resistor R4 connects the cathode of diode D8 (the midpoint of the interconnection between diode D8 and capacitor C) to the anode of diode D7 which is thus always forward biased.

When the voltage across resistor Rm (proportional to current IL) becomes higher than the reference voltage, the output of comparator 10 is drawn to its low supply, and the gate of transistor M is substantially at the potential of terminal 7. Transistor M thus is immediately turned off. The current in the lamp cancels. The comparator then almost immediately switches to its high supply, which turns transistor M back on. However, the turning-on of transistor M is slightly delayed by the time constant introduced by resistor R1 associated with the gate capacitance of transistor M. This switched mode operation is repeated as long as current $I_L$ is, upon each powering on, higher than the determined threshold value. At high temperature, that is, when the lamp filament resistance has reached its nominal value, the operation discussed previously in relation with FIG. 5 is repeated, the output of the comparator remaining at its high supply potential.

It should be noted that the limiting circuit described in relation with FIG. 8 also applies to the case where two limiting elements are used without a rectifying bridge. Two comparators (one for each halfwave) are then used.

Of course, the present invention is likely to have various alterations, modifications, and improvements which will readily occur to those skilled in the art. In particular, other components than those indicated in relation with FIGS. 5, 6, and 7 may be used to implement the limiting function, provided that they respect the above-described functionalities. Further, the respective sizings of the different components of the limiting device are within the abilities of those skilled in the art according to the lamp power. Moreover, other elements that resistors may be used for ensuring the local power supply of the limiting element by biasing it outside the limitation periods. One may, for example, use a transistor or any other element connected as a resistive element.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for limiting the surge current of a filament lamp, connected in series between the filament and a switch that can supply an a.c. voltage, and including at least one controllable active element, for limiting the current to a predetermined threshold value, and a biasing resistor connected between one of the power terminals of this element and its control terminal;

wherein the threshold value is set by a resistor that is used to measure the current through the lamp;

including at least one limiting element in series with the measurement resistor, a control terminal of the limiting element being connected to a control means for detecting the voltage across the measurement resistor; and wherein the means is formed of a bipolar transistor, between a base and an emitter of which is connected the measurement resistor, the limiting element being controlled in linear mode.

2. The current limiting circuit of claim 1, wherein the active element is connected as a unidirectional limiter and is associated with a rectifying bridge.

3. The current limiting circuit of claim 1, including two limiting elements, to limit the current in the lamp to the predetermined threshold value, each element being connected as a unidirectional limiter.

4. A filament bulb, including, in a cap, the current limiting circuit of claim 1.

5. A circuit for limiting the surge current of a filament lamp, connected in series between the filament and a switch that can supply an a.c. voltage, and including at least one controllable active element, for limiting the current to a predetermined threshold value, and a biasing resistor connected between one of the power terminals of this element and its control terminal;

wherein the threshold value is set by a measurement resistor that is used to measure the current through the lamp;

including at least one limiting element in series with the measurement resistor, a control terminal of the limiting element being connected to a control means for detecting the voltage across the measurement resistor; and wherein the means is formed of a comparator that compares the voltage across the measurement resistor with respect to a predetermined reference value, the limiting element being controlled in switched mode.

6. The current limiting circuit of claim 5, wherein the active element is connected as a unidirectional limiter and is associated with a rectifying bridge.

7. The current limiting circuit of claim 5, including two limiting elements, to limit the current in the lamp to the predetermined threshold value, each element being connected as a unidirectional limiter.

8. A filament bulb, including, in a cap, the current limiting circuit of claim 5.

9. A circuit for limiting the surge current of a filament lamp, connected in series between the filament and a switch that can supply an a.c. voltage, and including at least one controllable active element, for limiting the current to a predetermined threshold value, and a biasing resistor connected between one of the power terminals of this element and its control terminal;

including two limiting elements, to limit the current in the lamp to the predetermined threshold value, each element being connected as a unidirectional limiter; and including two field effect MOS transistors, connected in series between the switch and the filament, a measurement resistor being interposed between the two transistors and the current path including, upon each halfwave of the supply voltage, a parasitic diode of one of the two field effect transistors.

10. A circuit for limiting the current to a filament lamp and in which the circuit is coupled in series between the filament lamp and a switch that supplies an a.c. voltage at a single a.c. voltage terminal, said circuit comprising:

at least one controllable active element having a pair of main terminals and a control terminal;

said main terminals of said active element disposed between the filament lamp and the switch;

and at least one biasing resistor connected between one of the main terminals of the active element and the control terminal of the active element;

said active element and biasing resistor for limiting the current to the filament lamp to a predetermined threshold value;

further including a measuring resistor to set said threshold value;

wherein said measuring resistor is connected in series with one of said main terminals of said active element.

11. The current limiting circuit of claim 10, wherein said measuring resistor is connected in series between main terminals of the pair of active elements.

12. The current limiting circuit of claim 11, wherein said pair of active elements comprise a pair of MOS transistors.

13. The current limiting circuit of claim 12, further including a pair of bipolar transistors.

14. The current limiting circuit of claim 13, including a pair of biasing resistors each connected to a corresponding respective active element.

15. The current limiting circuit of claim 14, wherein the source of each of the MOS transistors is also connected to the base of the bipolar transistors, the collector of which is connected to the gate of the corresponding MOS transistors via the biasing resistors, to the drain of the MOS transistors.

16. The current limiting circuit of claim 15, wherein the emitter of a first bipolar transistor is connected to the source of the second MOS transistor and the emitter of a second bipolar transistor is connected to the source of the first MOS transistor.

17. The current limiting circuit of claim 16, wherein the second bipolar transistor detects the voltage across the measuring resistor and control, respectively, the MOS transistors.

18. The current limiting circuit of claim 17, wherein one of the bipolar transistors, has a base and an emitter connected to the measuring resistor.

19. The current limiting circuit of claim 18, wherein the MOS transistors are controlled in the linear mode.

20. The current limiting circuit of claim 17, further including a comparator that compares the voltage across the measuring resistor with respect to a predetermined reference value, the MOS transistors being controlled in a switched mode.

21. The current limiting circuit of claim 11, including a pair of biasing resistors each connected to a corresponding respective active element.

22. The current limiting circuit of claim 13, wherein as long as the voltage drop across the measuring resistor is lower than the base-emitter junction voltage of one of the bipolar transistors, this transistor remains off and the MOS transistor associated therewith is maintained on, by being biased by the at least one biasing resistor, in its operating range where its gate-source voltage is approximately equal to its drain-source voltage, and thus exhibits a low voltage drop.

23. The current limiting circuit of claim 10, wherein the active element is connected as a unidirectional limiter and is associated with a rectifying bridge.

24. The current limiting circuit of claim 10, wherein said circuit connects only to a single a.c. voltage terminal.

25. The current limiting circuit of claim 13, wherein said circuit is a two lead circuit that is connected in series with the filament of the lamp, without requiring a connection to more than one a.c. supply terminal.

* * * * *

UNITED STATES PATENT AND TRADEMARK OFFICE

CERTIFICATE OF CORRECTION

PATENT NO. : 6,445,144 B1
DATED : September 3, 2002
INVENTOR(S) : Luc Wuidart and Micheel Bardouillet It is certified that error appears in the above-identified patent and that said Letters Patent is hereby corrected as shown below:

Column 5,
Line 16, should read as follows: -- T2 as well as resistor R'1, operate during negative halfwaves. --

Signed and Sealed this

Thirty-first Day of December, 2002

JAMES E. ROGAN
*Director of the United States Patent and Trademark Office*